US005490633A

United States Patent [19]

Jeffries et al.

[11] Patent Number: 5,490,633

[45] **Date of Patent: * Feb. 13, 1996**

[54] APPARATUS FOR LIGAMENT MADE ELECTROSTATIC SPRAYING

[75] Inventors: Andrew Jeffries; Michael L. Green; Timothy J. Noakes, all of Clywd, Wales

[73] Assignee: Imperial Chemical Industries PLC, London, England

[ * ] Notice: The portion of the term of this patent subsequent to Mar. 8, 2011, has been disclaimed.

[21] Appl. No.: 118,247

[22] Filed: Sep. 9, 1993

Related U.S. Application Data

[63] Continuation of Ser. No. 843,078, Mar. 2, 1992, Pat. No. 5,292,067.

[30] Foreign Application Priority Data

| | | | |
|---|---|---|---|
| Mar. 1, 1991 | [GB] | United Kingdom | 9104373 |
| Mar. 1, 1991 | [GB] | United Kingdom | 9104374 |
| Oct. 15, 1991 | [EP] | European Pat. Off. | 91309472 |

[51] Int. Cl.[6] ..... B05B 5/00

[52] U.S. Cl. ..... 239/691; 239/696; 239/708

[58] Field of Search ..... 239/690, 705–708

[56] References Cited

U.S. PATENT DOCUMENTS

| | | | |
|---|---|---|---|
| 3,009,441 | 11/1961 | Juvinall | 239/691 X |
| 3,429,310 | 2/1969 | Jaffee et al. . | |
| 3,559,890 | 2/1971 | Brooks . | |
| 3,731,655 | 5/1973 | Griesser . | |
| 4,066,041 | 1/1978 | Bushoe et al. . | |
| 4,381,533 | 4/1983 | Coffee . | |
| 4,476,515 | 10/1984 | Coffee . | |
| 4,971,257 | 11/1990 | Birge . | |
| 5,121,884 | 6/1992 | Noakes et al. . | |
| 5,222,664 | 6/1993 | Noakes et al. | 239/696 X |

FOREIGN PATENT DOCUMENTS

| | | |
|---|---|---|
| 150571 | 8/1985 | European Pat. Off. . |
| 0234842 | 9/1987 | European Pat. Off. . |
| 0258016 | 3/1988 | European Pat. Off. . |
| 2081944 | 12/1971 | France . |
| 2113328 | 10/1978 | Germany . |
| 248518 | 5/1947 | Switzerland . |
| 841630 | 7/1960 | United Kingdom . |
| 9003224 | 4/1990 | WIPO . |

OTHER PUBLICATIONS

Smith, David P. H., "The Electrohydrodynamic Atomization of Liquids" IEE Transactions on Industry Application (1986) IA–22:527–535.

*Primary Examiner*—Andres Kashnikow
*Assistant Examiner*—Kevin P. Weldon
*Attorney, Agent, or Firm*—Cushman Darby & Cushman

[57] ABSTRACT

Relatively low resistivity liquids are formed into sprays under the influence of an applied electric field acting between a nozzle and the nozzle surroundings which may be at earth potential. The liquid issues from the nozzle as a ligament which undergoes necking to a diameter smaller than that of the nozzle orifice, thereby producing droplets with a volume median diameter less than the orifice diameter.

4 Claims, 4 Drawing Sheets

APPARATUS FOR LIGAMENT MADE ELECTROSTATIC SPRAYING

This is a continuation of U.S. application Ser. No. 07/843,078, filed Mar. 2, 1992, now U.S. Pat. No. 5,292,067.

BACKGROUND OF THE INVENTION

1. Field of the Invention

This invention relates to the electrostatic spraying of liquids in such a way that the liquid is initially projected from a spray head in the form of a ligament which thereafter breaks up into droplets under the influence of Coulombic forces to produce an atomized spray. Electrostatic spraying of this type is well known and is described in for example our prior British Patent No. 1569707.

2. Description of the Related Art

In conventional ligament mode spraying, it is widely recognised that liquid resistivity is vitally important to securing satisfactory atomization and that aqueous and other liquids which have relatively low resistivities become more and more unsuitable for use in ligament mode spraying as resistivity reduces below $1\times10^7$ ohm cm.

Although not limited thereto, the present invention is particularly concerned with the spraying of relatively low resistivity liquids such as aqueous, alcohol and aqueous/alcohol based liquids commonly used in personal care products such as deodorants, anti-perspirants, scents and hair sprays. In the past, many such products have been marketed as aerosol products in which a propellant is used to cause atomization of the liquid into fine droplets typically less than 50 microns in diameter.

However, because of the currently perceived environmental problems associated with the propellants conventionally used in aerosols, attention has turned to alternative methods of dispensing personal care liquids. Electrostatic spraying offers one alternative approach, but, where the ingredient to be dispensed is combined with an aqueous and/or alcohol carrier (or other relatively low resistivity liquid), current wisdom suggests that, with practical flow rates (typically several cc/min), such carriers will not allow dispensing of the product as droplets with a size range comparable to that attainable with aerosol sprays.

EP-A-152446 discloses a device for the electrostatic spraying of aqueous liquids and explains that, for reasons not completely understood, satisfactory atomization of aqueous formulations can only be achieved at flow rates that are undesirably low for many purposes and ligamentary formation is not obtained with aqueous liquids. EP-A-152446 proposes the use of a corona discharge needle electrode assembly in the vicinity of a sprayhead including a narrow metal tube having a diameter of 400 microns, the arrangement being such that the electrode assembly is symmetrically disposed about the emerging liquid and produces ions which bombard the liquid so that the liquid assumes a stable ligamentary form. It is stated that the illustrated embodiment produces droplets having a volume median diameter of 10 to 50 microns. For personal care products and like products for domestic use, it is considered undesirable to locate an assembly of needle electrodes in the vicinity of the outlet of the device both from an aesthetic standpoint and also in terms of the risk of potential electrostatic shock.

SUMMARY OF THE INVENTION

According to one aspect of the present invention there is provided a ligament mode electrostatic spraying device for use in spraying liquid having a resistivity less than about $1\times10^7$ Ω cm and greater than about $1\times10^4$ Ω cm, comprising a spray head having an orifice, means for supplying said liquid to the sprayhead for discharge through the orifice, and means for applying a high electrical potential to the spray head so that liquid supplied to the spray head is projected from the orifice preponderantly under the influence of electrostatic forces, the arrangement being such that the exit velocity of the liquid from the orifice and the potential gradient in the immediate vicinity of the orifice effect necking of the discharging liquid to form a ligament having a cross-sectional dimension substantially smaller than the dimension of the orifice.

According to a second aspect of the present invention there is provided a process for electrostatically spraying liquid having a resistivity less than about $1\times10^7$ Ω cm and greater than about $1\times10^4$ Ω cm, comprising supplying said liquid to a sprayhead for discharge through an orifice of the spray head, applying a high electrical potential so that liquid supplied to the spray head is projected from the orifice preponderantly under the influence of electrostatic forces, and controlling the exit velocity of the liquid from the orifice and the potential gradient in the immediate vicinity of the orifice in such a way as to effect necking of the discharging liquid to form a ligament having a cross-sectional dimension substantially smaller than the dimension of the orifice.

Advantageously the resistivity of the liquid is within the range of $1\times10^5$ to $5\times10^6$ ohm cm.

According to another aspect of the invention there is provided a ligament mode electrostatic spraying device for use in spraying liquids , comprising a spray head which defines an orifice, means for supplying said liquid to the sprayhead for discharge through the orifice, and means for applying a high electrical potential to the spray head so that liquid supplied to the spray head is projected from the orifice preponderantly under the influence of electrostatic forces, characterized in that, in order to effect ligamentary spraying of liquids having a resistivity less than about $1\times10^7$ Ω cm and greater than about $1\times10^4$ Ω cm in such a way that necking of the discharging liquid occurs to form a ligament having a cross-sectional dimension substantially smaller than the dimension of the orifice:

(a) at least that part of the sprayhead which defines the orifice is made of an electrically insulating material;

(b) the diameter of the orifice is no greater than 350 microns; and (c) the arrangement is such that the exit velocity of the liquid from the orifice is between 0.30 and 2.7 m $sec^{-1}$.

According to a further aspect of the invention there is provided a process for electrostatically spraying liquid having a resistivity less than about $1\times10^7$ Ω cm, comprising supplying said liquid to a sprayhead for discharge through an orifice of the spray head, the orifice having a diameter no greater than 350 microns and being formed in an electrically insulating part of the sprayhead, and applying a high electrical potential so that liquid supplied to the spray head is projected from the orifice as a ligament preponderantly under the influence of electrostatic forces, the liquid being supplied to the orifice so that the-exit velocity of the liquid from the orifice is between 0.30 and 2.7 m $sec^{-1}$ whereby the ligament undergoes necking to a dimension substantially smaller than the cross-sectional dimension of the orifice.

Where the liquid to be sprayed is only moderately polar, i.e., has a polarity less than water or an aqueous mixture, and has a resistivity between about $1\times10^6$ and $1\times10^7$ ohm cm, the geometry of the sprayhead may be conventional in that it may have a relatively sharply radiussed edge and/or a pronounced angular configuration. Where the liquid is, or contains, a polar component such as water and has a resistivity less than $1\times10^6$ ohm cm, it may still be possible to use conventional sprayhead geometry but, as the effective resistivity (which in the case of water is non-linearly related to the applied voltage) decreases, the onset of corona discharge tends to reduce the potential gradient available in the immediate vicinity of the orifice until substantial necking of the ligament is no longer secured. However, by modifying the potential gradient in the immediate vicinity of the orifice by means of non-conventional expedients as referred to hereinafter, it is possible to secure necking of the ligament-with liquids having resistivities down to about $1\times10^4$ ohm cm.

Normally, if a liquid is projected as a jet, it will be subject to hydraulic break up into droplets such that the ligament breaks up to produce droplets having a diameter which is about 1.9 times the diameter of the jet. In accordance with the invention, whilst the same will generally apply, the ligament is caused to undergo necking with the result that the droplets are produced with a volume median diameter substantially less than that which would be obtained from a simple hydraulic jet discharging from the orifice. Preferably, the extent of the necking is such that the droplets produced have a volume median diameter substantially less than the dimension of the orifice.

As used herein, the term "volume median diameter" is defined as the droplet diameter such that 50% of the volume of the droplets is no greater than such diameter and the remaining 50% of the volume of the droplets is greater than such diameter.

Preferably the arrangement is such that the volume median diameter is no greater than 150 microns and more preferably no greater than 100 microns.

Preferably at least that part of the spray head defining the orifice is of an electrically insulating material.

We have unexpectedly found that by controlling the above mentioned parameters then, provided that the liquid resistivity is within the range specified, it is possible to obtain ligament formation similar to that exhibited by high resistivity liquids which are characterized by the liquid being pulled into a "Taylor cone" from which it emerges as a stable ligament having a cross-sectional diameter much smaller than the dimension of the orifice from which the liquid issues. In this manner, it is possible to obtain smaller droplet sizes than would otherwise be obtainable using liquids having resistivities in the range specified.

Preferably the dimension of the orifice is no greater than 400 microns, more preferably no greater than 350 microns and most preferably between 125 and 250 to 300 microns.

The applied potential is preferably of positive polarity since negative potentials are more likely to give rise to corona discharge which, in general, is undesirable. Usually the applied potential will be at least 5 kV and typically is in the range of 10 to 20 kV but may be greater than 20 kV, especially in the case of liquids having resistivities towards the lower end of the above specified ranges.

The flow rate of the liquid from the orifice is preferably up to 8 cc/min and more preferably from 1 to 4 cc/min.

The pressure applied to the liquid during feed to the orifice will generally be low in order to achieve suitable exit velocities at the orifice. The applied pressure will depend on the viscosity of the liquid since the exit velocity for a given pressure will be dependent on viscosity. For liquids such as water and ethanol, the applied pressure is typically in the range of 0.5 to 5 psi and preferably in the range of 1 to 3 psi.

The invention may be embodied in a device in which the application of pressure for determining the exit velocity of the liquid from the orifice is derived from effort applied by the user, in which case means is provided for translating effort applied by the user into a predetermined pressure or a pressure within a predetermined range such that, irrespective of the effort applied by the user, the exit velocity of the liquid is within the range defined specified below.

In one embodiment of the invention, the device is suitable for handheld use and includes a user-operable member controlling operation of pressure applying means for applying pressure to liquid stored in a container within the housing of the device. The container may be flexible walled whereby pressure is applied to the liquid by the application of compression to the container and the pressure applying means conveniently includes a pad of resiliently deformable material through the agency of which force derived from operation of said user-operable member is applied to the flexible walled container, the characteristics of said pad being such that the force is translated into a pressure within the desired range.

In general, the exit velocity (linear velocity) for the liquid discharging from the orifice will be no greater than about 2.7 m $sec^{-1}$: and no less than about 0.30 m (preferably 0.35) $sec^{-1}$. Preferably, the exit velocity is no greater than 2.1 m $sec^{-1}$ and preferably no less than 0.40 m $sec^{-1}$. In practice, the actual exit velocities needed to achieve satisfactory spraying will depend on the nature of the liquid to be sprayed and particularly on the extent to which the liquid tends to wet the surface of the nozzle immediately surrounding the orifice. Liquids which have a greater tendency to wet the surface will usually require a higher exit velocity than liquids with a low wetting tendency.

More specifically, the invention may be embodied in a device for electrostatically spraying fluids, comprising a housing for receiving a container of the type which is operable to dispense its contents in response to being compressed, a nozzle from which the fluid is to be sprayed in use, means for compressing the container to feed fluid to the nozzle, and high voltage means for applying electrostatic potential to the fluid such that the fluid issues from the device in the form of an electrically charged spray, said compressing means comprising a user-displaceable member and means for non-linearly translating displacement into compressive force such that the liquid is discharged from the nozzle at an exit velocity within the range 0.3 to 2.7 m $sec^{-1}$ (preferably 0.4 to 2.1 m $sec^{-1}$), the user-displaceable member having a predetermined operational range of spray-effecting displacement and the arrangement being such that the translating means is effective to produce a compressive force sufficient to achieve an exit velocity with said exit velocity range irrespective of the displacement of said member within its operational range.

Preferably liquid feed through the nozzle is via a passageway having an upstream section of large cross-section and a downstream section of smaller section, the orifice being defined by said downstream section and the downstream section having an aspect ratio (i.e., length to diameter) of less than 10:1, and more preferably less than 5:1. In this manner, pressure drop through the nozzle may be kept relatively small which may be advantageous in circumstances where the liquid is to be dispensed from a flexible walled container such as a sachet by means of pressure derived from effort applied by the user in operating the device.

Where required, control of the potential gradient in the vicinity of the orifice may be achieved by appropriate shaping of the nozzle structure defining the discharge orifice. In particular with liquids having resistivities somewhat lower than about $1\times10^6$ ohm cm, it is important to attenuate the potential gradient in the immediate vicinity of the orifice so as provide sufficient potential gradient to promote necking of the liquid ligaments produced from the orifice while reducing the very steep gradients normally associated with pointed nozzle tips which, with low resistivity liquids as used in the present invention, would otherwise give rise to corona discharge from the liquid jet. Such attenuation can be achieved by suitable design of the nozzle geometry and/or by means of a field adjusting electrode or equivalent means located adjacent to the nozzle orifice for developing a potential which has the same polarity as that applied to the liquid. Such equivalent means may for example be in the form of a collar, shroud or other projecting formation composed of substantially electrically insulating material and so located that a potential build-up develops as a result of charge accumulating thereon from stray corona discharges that inevitably occur during operation of the device, such potential build-up having the same polarity as that applied to the liquid.

Where a collar, shroud or other projecting formation is used to attenuate potential gradient in the vicinity of the orifice, it may be adjustable to allow the potential gradient to be optimised according to the resistivity of the liquid to be sprayed.

In conventional nozzle designs for electrostatic spraying devices, the nozzle Geometry tends to use sharp edges or sharply radiussed edges in the immediate vicinity of the discharge orifice so as to intensify the electric field. In contrast, especially where low resistivity liquids are to be sprayed, i.e., having resistivities lower than $1\times10^6$ ohm cm, nozzle designs suitable for use in the present invention will tend to avoid local field intensifying effects and, in order to achieve attenuation of the potential Gradient for the purposes of the present invention, the nozzle Geometry may be of a blunt or bluff-ended configuration such that the surface(s) immediately proximate to the discharge orifice is flat or has a relatively shallow radius of curvature and extends in a plane which is generally parallel or co-planar with the plane of the orifice.

A suitable nozzle design, whether based on nozzle geometry or the use of a collar, shroud or other projecting formation, will attenuate the potential gradient local to the orifice to such an extent that, when the device is oriented for spraying in a direction perpendicular to the Gravitational field, the device if operated with an applied voltage of up to 25 kV with a liquid having a resistivity of the order of $8\times10^5$ ohm cm and an exit velocity of 1 m $sec^{-1}$ discharged via an orifice of 125 microns diameter, will produce a ligament having a diameter which is no greater than 50% of the diameter of the orifice.

BRIEF DESCRIPTION OF THE DRAWINGS

The invention will now be described by way of example only with reference to the accompanying drawings, in which.

DETAILED DESCRIPTION OF THE PRESENTLY PREFERRED EXEMPLARY EMBODIMENTS

Figure 1:
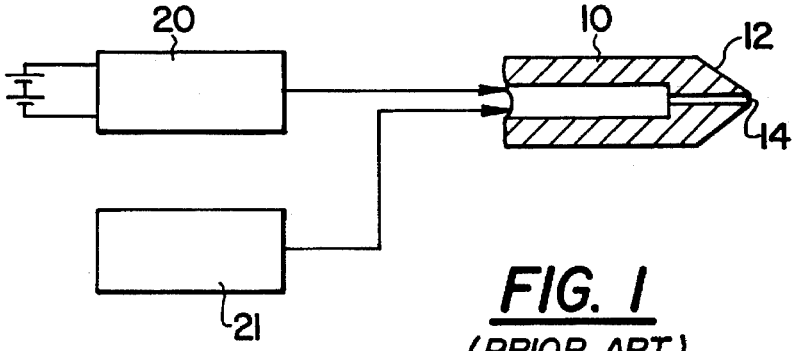
FIG. 1 (PRIOR ART)
FIG. 1 is a diagrammatic view of a conventional electrostatic spraying nozzle.

Referring to FIG. 1, this shows a conventional nozzle 10 designed for use in electrostatic spraying devices of the type in which electric field induced ligamentary spraying of the liquid is produced. The nozzle may be of an electrically insulating material, such as a plastics material (e.g., ABS, polypropylene, polyethylene, polyvinylchloride, acrylic, polycarbonate, or acetal). Where the liquid to be sprayed is highly insulating, the resistivity of the material of the nozzle may be smaller so that it acts as a resistor in parallel with the resistance presented by the liquid to avoid undue attenuation of the high voltage applied to the nozzle.

A high voltage, typically greater than 10 kV is applied by means of an HT generator 20 to the tip 12 of the nozzle, either via the liquid itself or via a conductor (not shown) which may be embedded within the internal wall of the nozzle so that it is contacted by the liquid as the liquid is fed from a reservoir 21 to the nozzle orifice. Conventionally, the objective is to intensify the electric field between the tip of the nozzle and earth while minimising corona discharge. This is implemented by providing a sharply radiussed edge at the tip 12 which defines the discharge orifice 14 of the nozzle and by designing the nozzle with a pronounced angular configuration. In conventional designs, the nozzle orifice is typically about 600 microns in diameter.

The liquid is supplied to the nozzle by any suitable means at a relatively low pressure, so as to give a flow rate of e.g. 2 cc/min, whereby the liquid arrives at the nozzle tip 12 at a low pressure which is not sufficient to cause any or significant atomisation, atomization being caused predominantly as a result of electric field induced ligamentary spraying of the liquid followed by break-up of the ligament into droplets.

In practice, efficient operation of such a nozzle using conventional liquid flow rates (i.e., at least 2 cc/min) requires the spraying liquid to have a resistivity of at least $1\times10^7$ ohm cm which excludes lower resistivity liquids such as certain aqueous, alcohol and aqueous/alcohol based liquids commonly used in personal care products. Liquids with lower resistivities than this can be atomised by ligamentary spraying but ultra-low flow rates have to be used, e.g., 0.1 cc/min. If an attempt is made to use a conventional nozzle design with low resistivity liquids, as resistivity is reduced below about $1\times10^7$ ohm cm, the spray becomes polydisperse, consisting of a mixture of coarse and very fine spray droplets and may even spit or drop from the nozzle. As resistivity reduces further, the spray degrades even further until corona discharge from the liquid itself occurs to such an extent that the potential gradient available for atomisation becomes totally ineffective.

We have found that efficient ligamentary spraying of lower resistivity liquids may, within certain limits, be secured particularly for liquids with resistivities less than $1\times10^7$ ohm cm but greater than $1\times10^4$ ohm cm thus allowing effective atomisation of distilled water and the lower alcohols, ethanol and methanol. Contrary to conventional wisdom relating to nozzle design, a nozzle suitable for use in certain aspects of the invention does not employ a sharply radiussed edge or a sharply angular configuration.

Figure 2:
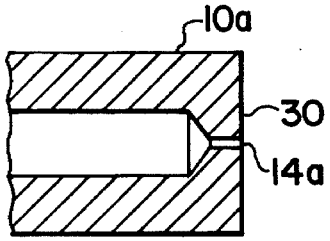
FIGS. 2, 3 and 4 are similar views to that of FIG. 1 but showing nozzle configurations in accordance with the invention.

Referring to FIG. 2, one form of nozzle 10a that may be used for ligamentary spraying of lower resistivity liquids has a blunt or bluff-ended configuration in which the orifice 14*a* is formed within a planar end wall 30 of the nozzle. Thus, the orifice 14*a* is surrounded by an extended surface (typically 8 mm in diameter) which is generally parallel or coplanar with the plane of the orifice. The effect of the extended surface is to attenuate the potential gradient in the immediate vicinity of the orifice.

When such a nozzle is used in an otherwise conventional ligamentary spraying device with low resistivity liquid supplied at conventional flow rates, e.g., several cc/min, it was found that electric field induced ligament formation was obtained and the ligaments were observed to neck at a short distance beyond the orifice to a diameter somewhat less than the diameter of the orifice. The resulting ligament subsequently broke up to form droplets having a median drop diameter substantially less than that obtainable with a ligament having the same diameter as the orifice.

When the flow rate of the liquid to the orifice was reduced to less than about 1 cc/min, satisfactory ligamentary spraying ceased and the liquid was found to merely wet the end face of the nozzle and spit/drip in a random overcharged electrostatic mode from the lowest point on the nozzle. When the flow rate was increased to above 8 cc/min, the liquid was found to spray as a ligament primarily because of the higher flow rate, no necking was observed and the droplets formed following break up were of size of the order of 1.9 times larger than the orifice diameter.

Figure 3:
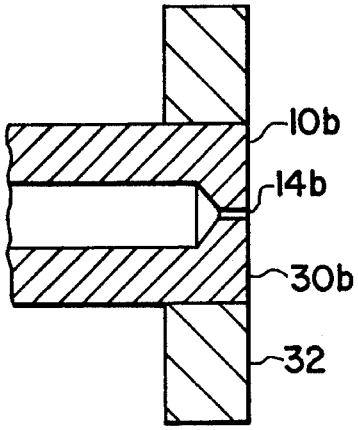

FIG. 3 illustrates a modification in which the surface surrounding the orifice 14*b* is extended to an even greater extent than in the embodiment of FIG. 2 by fitting the nozzle 10*b* into an insulating disc 32, of for example plastics material, having one face substantially flush with the end wall 30*b*. Using the same dimensions as those specified above for the nozzle of FIG. 2 and using a disc 32 with a diameter of 30 mm, the nozzle 14*b* was found to give similar results to that of FIG. 2.

Figure 4:
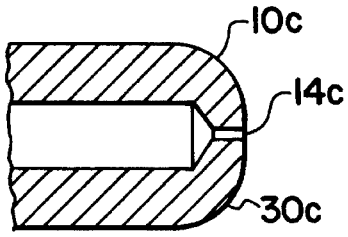

FIG. 4 illustrates another form of nozzle configuration in which the nozzle is of blunt or bluff-ended configuration. In this instance, the end face 30*c* of the nozzle 10*c* is of curvilinear configuration having a relatively large radius of curvature so as to provide an extended surface surrounding the orifice 14*c* which has the effect of attenuating the potential gradient in the immediate vicinity of the orifice.

Figure 5:
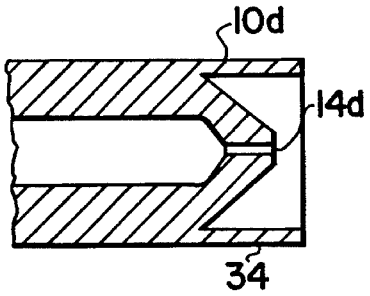
FIG. 5 is another nozzle configuration employing a collar or shroud in order to attenuate the potential gradient locally of the nozzle discharge orifice.

FIG. 5 illustrates an alternative embodiment in which the nozzle 10*d* is provided with an axially projecting collar or shroud 34 encircling the nozzle orifice 14d. The collar 34 is composed of an electrically insulating material, such as a suitable plastics material, and during operation of the device accumulates charge as a result of the small corona discharges that inevitably occur from the nozzle and thereby builds up a potential of the same polarity as the voltage applied to the liquid at the nozzle tip. The potential prevailing at the collar 34 is effective to attenuate the potential gradient in the immediate vicinity of the orifice 14*d*.

In experiments using the nozzle configuration shown in FIG. 2, water having a resistivity of about $2\times10^5$ ohm cm was found to produce a satisfactory atomized spray from an orifice of diameter 250 microns for flow rates of 1.15 (0.39 m/sec) and 2.3 cc/min (0.78 m/sec), the volume median diameter for these flow rates being of the order of 30 and 45 microns respectively at an applied HT of 24 kV and the bluff end face of the nozzle being 6 mm in diameter. Similarly, using the nozzle configuration shown in FIG. 3 produced satisfactorily atomised sprays in which the volume median diameter of the droplets was of the order of 35, 50 and 85 microns for flow rates of 1.15 cc/min (0.39 m/sec), 2.3 cc/min (0.78 m/sec) and 5.72 cc/min (1.94 m/sec), with an orifice of 250 microns diameter, a nozzle end face of 6 mm diameter, a surrounding disc (32) of 30 mm diameter and water having a resistivity of about $5.35\times10^5$ ohm cm.

A notable difference between the nozzles of FIGS. 2 and 3 was current consumption during spraying in that the nozzle configuration with the more extended end face (i.e. that of FIG. 3) consumed substantially less current than that of FIG. 2 when used to spray water.

Figure 6:
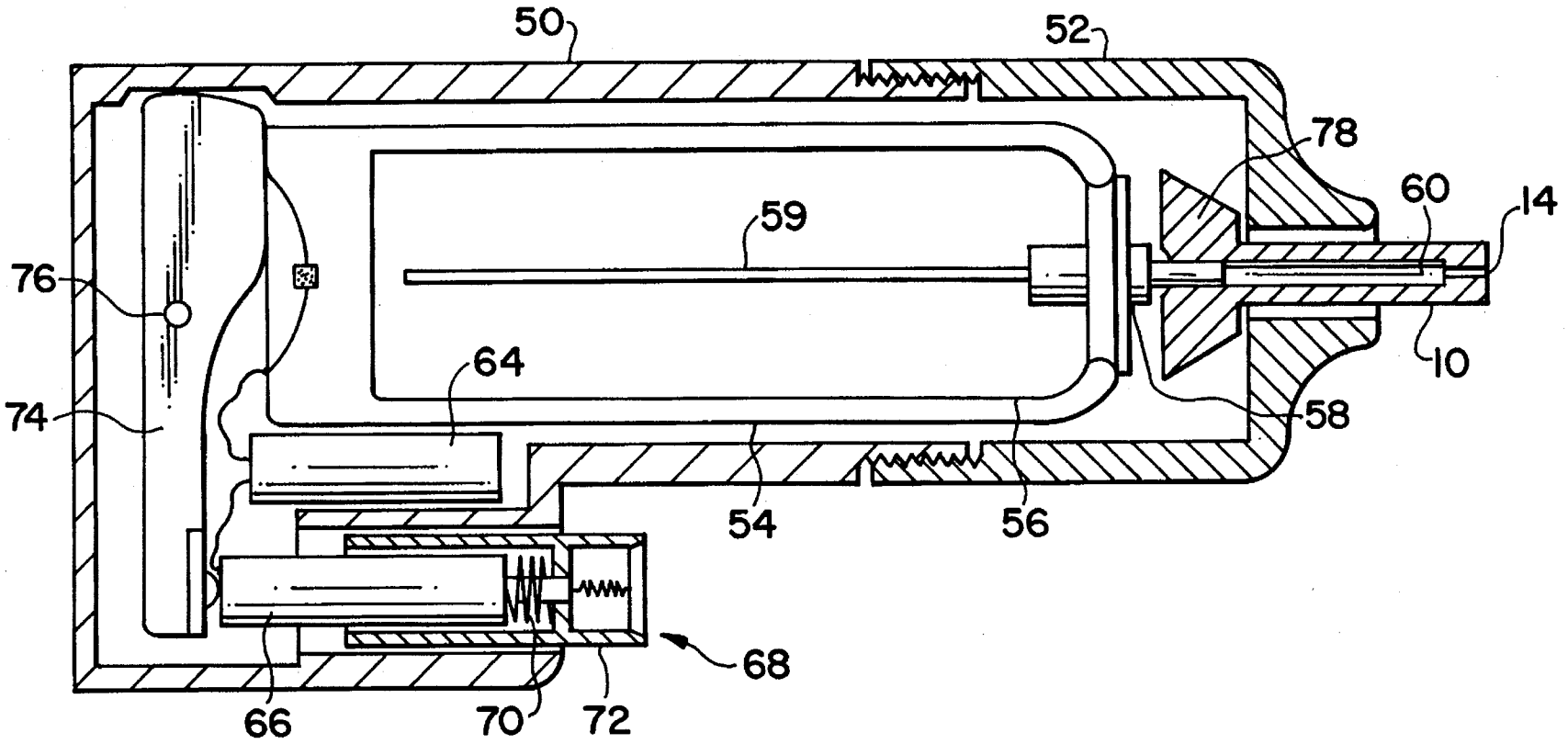
FIG. 6 is a diagrammatic longitudinal sectional view of an electrostatic spraying device incorporating a nozzle in accordance with the invention.

Referring to FIG. 6, this shows a nozzle of the type shown in FIG. 2 incorporated in a device suitable for handheld use and for use in the dispensing of personal care products using a liquid in which the active ingredients are dispersed or dissolved in a carrier which may be aqueous or an alcohol or a combination of both, such liquid having a resistivity of less than $1\times10^7$ ohm cm. The device comprises a housing 50 including a removable cap 52, which may be fitted as a snap fit, bayonet fit or a screwthreaded fit. The housing 50 and the cap 52 are typically fabricated from an insulating plastics material. The housing 50 serves to receive a container 54 for the liquid to be dispensed, the container being replaceable when its contents are spent by removal of the cap 50 various forms of container may be used and, in this instance, the container is in the form of so-called barrier pack in which the liquid is contained within a metal foil sack 56 and pressurised by a propellant fluid within the space between the sack 56 and the container 54. The propellant fluid is at all times retained within the container, i.e., it is not discharged with the liquid to be dispensed. The container 54 is closed by a valve assembly 58 through which the contents of the sack are discharged when the valve is open.

The valve 58 is of the type used in aerosol canisters and opening and closing thereof is effected by displacement of the valve axially towards to the container, spring means being provided to bias the valve to its closed position. Displacement of the valve 58 towards the container 54 opens the valve to allow the propellant to discharge the liquid in the sack 56 into a passage 60 in a nozzle 10 of electrically insulating material which is mounted on the valve assembly 58. The passage 60 terminates in a narrow bore 14 which forms the nozzle orifice and also limits the liquid flow rate, typically 2 or 3 cc/min, so that the liquid arrives at the nozzle orifice at a very low pressure which, in itself, is insufficient to cause any or effective atomisation of the liquid. The liquid feed to the valve assembly 58 is via a dip tube 59 which acts as a flow restrictor to assist in limiting the pressure of the liquid supplied to the nozzle orifice within desired limits consistent with the required exit velocity. The nozzle orifice 14 also provides a pressure drop but, for ease of fabrication, the arrangement is such that the dip tube 59 provides the major part of the pressure drop so that the aspect ratio (length to diameter) of the orifice passage 14 can be kept small, e.g., less than 4:1.

A high voltage, typically of the order of 10 to 25 kV is applied to the liquid prior to discharge from the nozzle orifice by means of an HT generator 64 which is powered by battery supply 66, both the generator and the battery supply being accommodated within the housing 50. The high voltage output of the generator is applied to the liquid via the container 54 which may be of metal (or, if of an insulating material may incorporate an strip of conductive material leading to the valve assembly) and via the valve assembly 58. The battery supply circuit for the generator includes a user-operable switch 68 which is biased to an open position by spring 70, the switch including a sleeve 72 which is slidably received in an opening in the housing. Depression of the switch 68 by the user closes the circuit to energise the generator and, in addition, provides an earth return path via the user and rocks a lever 74 about pivot point 76 to displace the container 54 towards the cap 52. The nozzle 10 includes a trailing head 78 which, on such displacement of the container, abuts the internal end face of the cap 52 so that continued displacement of the container causes depression of the valve assembly to effect supply of liquid to the nozzle orifice. Spring means (which may be constituted by the spring associated with the value 58 or by a separate unshown spring) is arranged to return the various components to the illustrated positions when the switch 68 is released.

The nozzle 10 has an end face of blunt or bluff configuration as in FIG. 2 so that the resulting attenuation of the potential gradient in the immediate vicinity of the nozzle orifice, in conjunction with the exit velocity of the liquid, produces necking of the liquid ligament discharged from the nozzle under the influence of the electric field generated by the generator. The ligament thereafter breaks up to produce droplets with a volume median diameter somewhat less than the diameter of the orifice 14.

Figure 7:
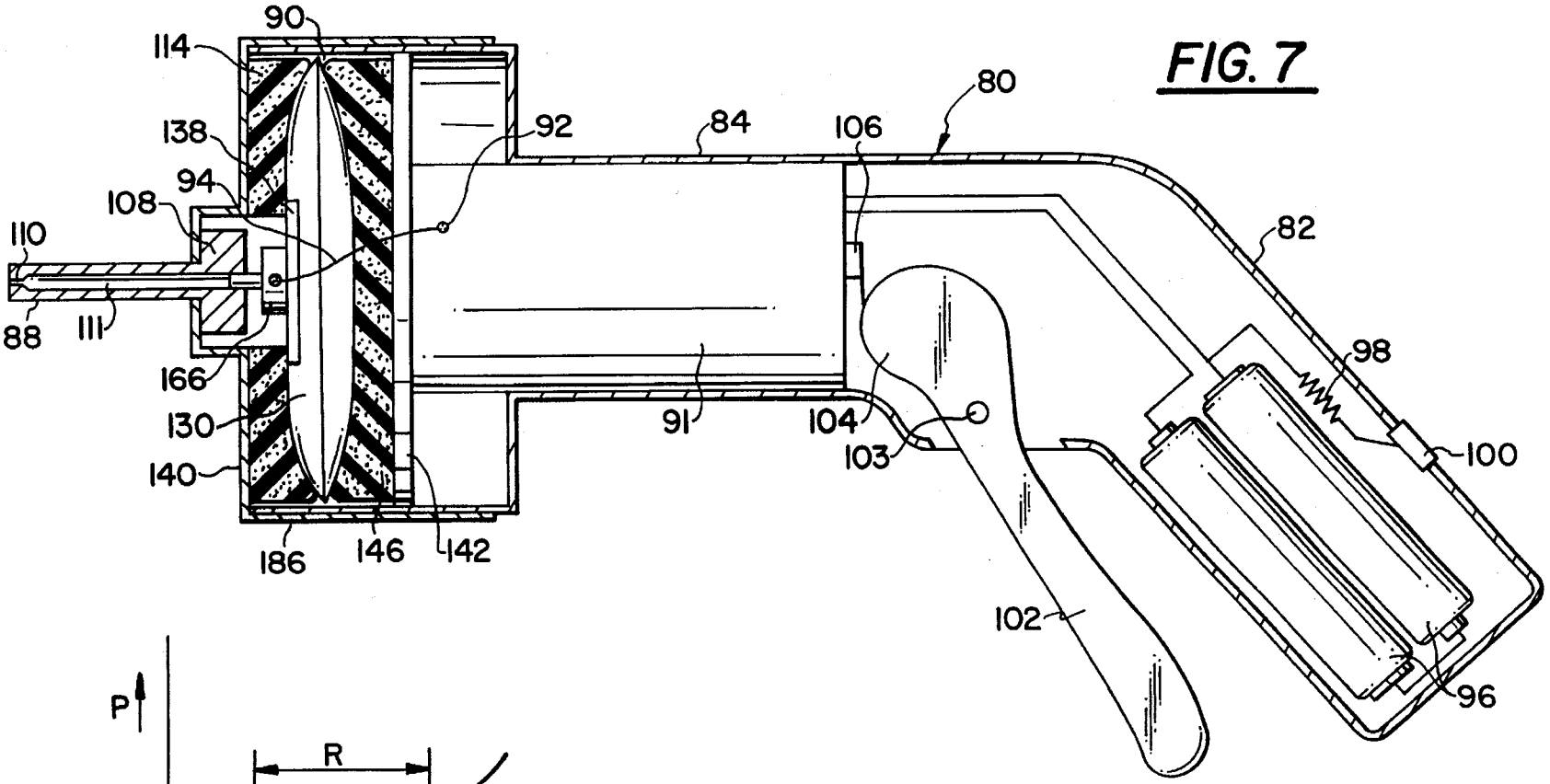
FIG. 7 is diagrammatic view illustrating the principle of operation of one form of device in accordance with the invention.

Referring now to FIG. 7, there is shown a handheld electrostatic spraying device in which the pressure for effecting delivery of the liquid to the nozzle is derived from effort applied by the user's hand. As shown, the device is in the form of a pistol shaped housing 80 having a hand grip 82 and a generally cylindrical main body portion 84. The body portion 84 is fitted with a removable cap 86 which mounts a nozzle piece 88 from which liquid is electrostatically sprayed in use. Although shown as having an angular configuration, the nozzle piece 88 is constructed with a bluff or blunt end face as described above. The cap 86 closes the open end of a cavity 90 which receives the liquid container 130 in the form of a flexible walled sachet located between a resilient foam pad 114 adjacent a fixed end wall 140 of the cap 86 and a pad 146 of resiliently deformable material carried by a movable drive plate 142 which is mounted slidably within the cavity 90 and is connected to a piston 91 slidable within the body portion 84. Spring means (not shown) is provided to bias the piston to the position shown in which the pad 146 is not compressed or only compressed to a limited extent.

The piston 91 is constituted by an HT generator for producing from a low voltage source, a high voltage suitable for effecting electrostatic spraying. The generator has a high voltage output pole 92 connected to the outlet 166 of the sachet 130 by a flexible lead 94. The low voltage source comprises a battery pack 96 accommodated in the hand grip portion 82. A ground for the circuit is provided via a resistor 98 and a contact 100 exposed for contact with the user's hand.

Operation of the device is controlled by a trigger 102 pivoted at 103 and having a cam portion 104 arranged to bear against the adjacent end of the piston/generator 91 so that, as the trigger is squeezed, the piston is displaced to the left as seen in FIG. 7 thereby moving the drive plate 142 and compressing the sachet 130. In the initial part of trigger movement, the cam 104 is arranged to close a microswitch 106 which completes the circuit to enable the generator to produce a high voltage output at terminal 92 for application to the sachet outlet 166. The initial displacement of the drive plate 142 advances the sachet and compresses the pad 114 which may be less stiff than the pad 146, and the nozzle 108 of the sachet outlet 166 is urged against an abutment surface within the nozzle piece 88 causing the nozzle 108 to be depressed relative to the outlet 166 thereby opening the valve of outlet 166. Thus, initial displacement of the drive plate 142 serves to effect opening of the valve. Continued displacement of the drive plate 142 compresses the sachet to effect dispensing of the liquid at a controlled rate as described below.

The liquid emerging through the nozzle 108 of the valved outlet 166 enters a passageway comprising sections 110 and 111 extending to the tip of the nozzle piece 88. An electrostatic potential is applied to the tip via the terminal 92, lead 94, outlet 66 and the liquid. The device is intended to effect ligamentary spraying of liquids having resistivities no greater than $1\times10^7$ ohm cm and the nozzle piece 88 is therefore designed accordingly, as described hereinbefore. 10 The force exerted on the valved outlet of the sachet during the initial displacement of the drive plate 142 is transmitted via the flange 138 of the sachet 130, which flange will be substantially rigid or at least substantially more rigid than the flexible walls of the sachet. The flange 138 may be larger than shown in FIG. 7 and, in some circumstances, the flange may be substantially co-extensive with one wall of the sachet or the sachet may be fabricated with one wall flexible and a second wall substantially rigid or at least substantially more rigid than the flexible wall, the more rigid wall then being used to transmit force from the drive plate 142 to the valved outlet of the sachet.

The pad 114 serves to urge the sachet back to the position shown in FIG. 7 but it will be appreciated that its function may be achieved by some other form of spring.

It will be seen that compressive loading is applied to the sachet by moving the plate 142 towards the plate 140 which has the effect of compressing the pad 146 which, in turn, will deform in such a way as to conform with the shape of the sachet 130 and translate the force acting on the plate 142 into pressure applied substantially uniformly over the liquid-containing portion of the sachet.

When the valved outlet 166 is open, as the liquid discharges from the sachet, the sachet-contacting face of the pad 146 will continue to conform to the shape of the liquid containing portion of the sachet as the latter changes. The pressure to which the sachet 130 is supported is such that a substantially constant rate of dispensing is achieved irrespective of whether the sachet is full, near empty or in an intermediate condition and irrespective of the effort applied by the user via the trigger 102. In this event, the material of which the pad 146 (and the pad 114) is composed is selected so that the pressure applied to the sachet remains substantially constant irrespective of the extent to which the pad 146 is deformed.

Figure 8:
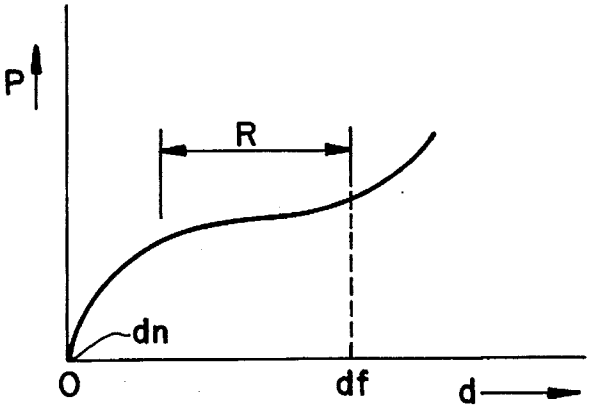
FIG. 8 is a schematic graph of pressure v deformation for material suitable in providing dispensing at an exit velocity within desired limits.

FIG. 8 illustrates schematically the characteristics required of a material for this purpose. In the graph of FIG. 8, the ordinate d represents the extent to which the pad is deformed from its natural thickness dimension $d_n$ and the abscissa P represents the pressure to which the sachet is subjected as a result of such deformation. A material suitable for effecting dispensing at a substantially constant rate will exhibit a non-linear curve having a section R over which the rate of change of pressure P with respect to d is reduced compared with other sections of the curve.

Thus, by pre-loading the pad so that it is initially compressed to the point $d_f$ when the sachet is full and by selecting a material for which the range R is at least equal to the reduction in deformation that the pad undergoes in changing shape in conformity with the full and empty conditions of the sachet, it will be seen that (assuming the relative spacing between the plates 142 and 140 is maintained constant at the pre-load setting), the sachet will be subjected to a substantially constant pressure throughout the dispensing cycle, i.e., from full to empty.

The curve shown in FIG. 8 illustrates an ideal case. In practice, the plateau may not be as well-defined or as steep; nevertheless, a foam material will be suitable for many applications requiring substantially constant rate dispensing if it exhibits a plateau region in which the force remains reasonably constant over a range of compression/displacement of the foam. Also, many foams when compressed to a given extent will produce a force which decays with time and again selection of the foam for a particular application requiring substantially constant rate dispensing will be made with regard to the decay characteristics of the foam and, especially in the case of applications likely to involve sustained spraying and hence compression of the foam, due regard must be given to its decay characteristics. For many spraying applications, e.g., spraying of personal care products such as perfumes, deodorants and hairsprays, spraying is only sustained for a relatively short time and hence the decay characteristics of the foam will not affect spraying unduly. A suitable foam exhibiting appropriate behaviour for use in this aspect of the invention is an elastic open cell foam such as polyether foam, e.g., having a density of the order of 40 $kg/m^3$. Suitable polyether foams are those supplied by Foam Engineers Limited of High Wycombe, England as grades ET14W, ET22Y and ET29G.

Figure 9:
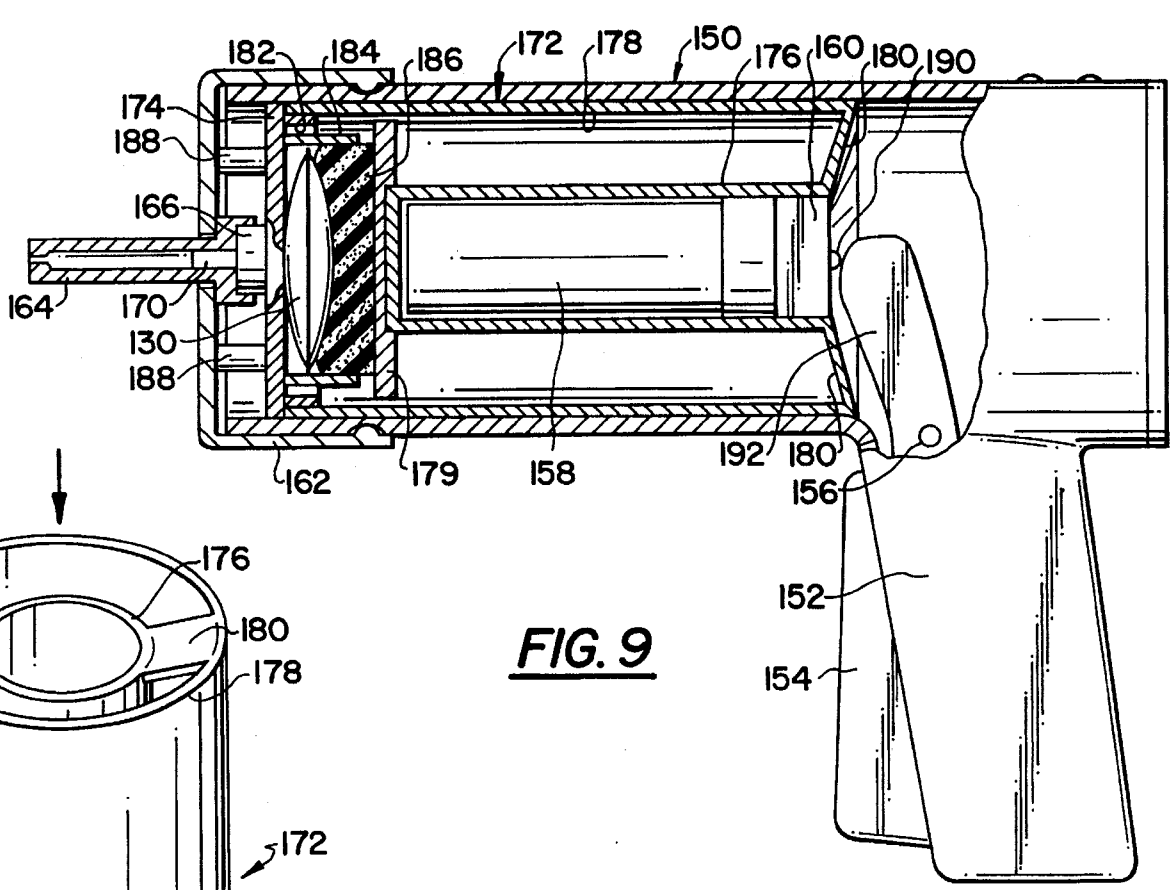
FIG. 9 illustrates schematically another form of electrostatic spraying device in accordance with the invention.
Figure 10B:
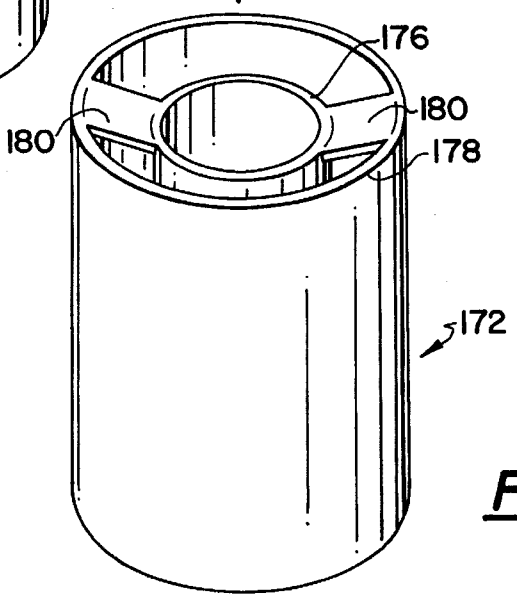
FIGS. 10A and 10B illustrate in perspective a component of the device shown in FIG. 9.
Figure 10A:
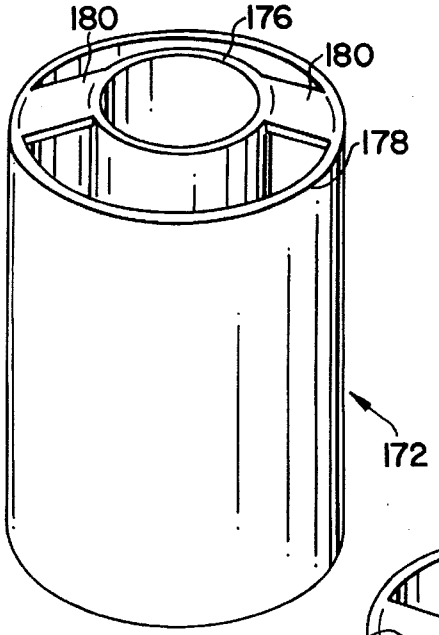

Referring now to FIGS. 9, 10A and 10B, the device shown comprises a housing 150 having a handgrip portion 152 provided with a user-operable trigger 154 pivoted at 156 and spring-loaded outwardly of the handgrip portion 152 to an inoperative position by unshown spring means. In this embodiment, as illustrated, from the electrical standpoint only the high voltage generator 158 and microswitch 160 are shown, the remaining circuitry being generally similar to that shown in the embodiment of FIG. 7. The trigger 154 is arranged to co-operate with the switch 160 which forms part of the low voltage circuitry associated with the high voltage generator 158, the switch being arranged to be operated in response to initial displacement of the trigger 154 from its inoperative position thereby powering the generator 158. The handgrip portion or the trigger may be provided with a contact (not shown) exposed for engagement with the hand so as to provide a path to ground in use.

At one end, the housing terminates in a removable cap 162 which may have a snap fit or screw-threaded connection with the housing 150. A counter-bored nozzle 164 projects through the cap 162 and is supplied with liquid from a container 130 within the housing. The container is in the form of a sachet having the same design as described with reference to FIG. 7, the valved outlet 166 of the sachet comprising a nozzle portion 170 which fits into the larger diameter section of the nozzle 164. The high voltage output of the generator 158 is electrically connected to a conductive part of the sachet outlet 166 so that high voltage is applied in use to the liquid supplied to the nozzle 164.

The sachet 130 and the generator 158 are received within a carrier 172 which is slidably mounted within the housing 150 for movement towards and away from the cap 162, movement towards the cap occuring in response to squeezing of the trigger 154 and movement in the opposite direction being effected, on release of the trigger, by unshown spring means which may, for instance, act between the cap 162 and a closure 174 located at the forward end of the carrier 172. This spring means may also be effective to return the trigger to its inoperative position in which the switch 160 is open and the generator 158 is de-energised.

As shown more clearly in FIGS. 10A and 10B, the carrier 172 has a double-sleeved configuration comprising an inner sleeve 176 and an outer sleeve 178 which are united at one end of the carrier by springy webs 180 which permit the inner sleeve to move axially relative to the outer sleeve. In FIG. 10A, the carrier is shown in its unstressed condition in which the inner sleeve projects slightly beyond the outer sleeve. In FIG. 10B, the carrier is shown in the condition obtaining when the inner sleeve is displaced inwardly relative to the outer sleeve, resulting in stressing of the webs 180 which tend to bias the inner sleeve back to the position shown in FIG. 10A. The inner sleeve 176 forms a housing for the generator 158 and also receives the microswitch 160. The generator and the microswitch are securely fixed within the inner sleeve, for example by means of potting resin which may fill the space between the microswitch 160 and the generator 158 and also encapsulate electrical leads (not shown) connecting the generator to the microswitch and to a battery pack (not shown). The inner sleeve 176 is shorter in length than the outer sleeve 172 and its forward end has a drive plate 179 secured thereto in spaced relation to closure 174 which closes the forward end of the outer sleeve. The closure plate 174 is releasably attached to the carrier and may be screw-threadedly connected to the outer sleeve 178, for instance by screw threads provided on an annular flange 182 on the closure 174 and on the inner periphery of the outer sleeve 178.

The inwardly presented face of the closure 174 is formed with an annular retaining flange 184 defining a cavity for reception of the sachet 130, the closure 174 being formed with an opening in which the valved outlet 168 of the sachet is engaged so that the outlet is captive with the closure 174. A foam pad 186 is interposed between the sachet and the drive plate 179 and may either be secured to the drive plate 179 and received within the cavity defined by the flange 184 or the pad 186 may be separate from the drive plate 179 and housed within the cavity. If desired, a layer of resiliently deformable foam material may also be provided between the sachet and the closure 176 (in similar fashion to the embodiment of FIG. 7). Forward movement of the carrier 172 is limited by stops 188 on the cap 162.

When the trigger 154 is in its inoperative position, the carrier 172 is shifted to the right, the closure 174 is spaced from the stops 188 and the inner sleeve 176 projects outwardly beyond the outer sleeve 178 as shown in FIG. 10A. In these circumstances, the nozzle portion 170 of the sachet 130 is extended with consequent closure of the valve and the microswitch actuator 190 is also extended so that the microswitch is open and the generator is de-energised. Upon squeezing of the trigger 154, the initial displacement of the trigger depresses the microswitch actuator 190 via lever arm 192 to close the switch and energise the generator 158. The webs 180 are so designed that, at this point, they provide sufficient spring force to allow continued displacement of the trigger to move the carrier as a unit, by contact between the actuator 190 and the lever arm 192, towards the cap 162 causing the nozzle portion 170 to depress in the manner of an aerosol valve thereby opening the valve to permit supply of liquid from the sachet 166 to the nozzle 164. Axial movement of the carrier continues until the closure 174 abuts the stops 188 at which point continued displacement of the trigger overcomes the spring resistance offered by the webs 180 and is translated into inward movement of the inner sleeve 176 relative to the outer sleeve 178 (as shown in FIG. 9). Such relative movement serves to compress the pad 186 with consequent compression of the sachet 166 and supply of liquid to the nozzle 164 for electrostatic spraying.

When the trigger 154 is released, the various components restore to the condition described above prior to operation of the trigger. The device may be designed to produce a relatively uniform rate of spraying such that the exit velocity of the liquid is for example some value between 0.4 and 2.1 m $sec^{-1}$ irrespective of how forcibly the device is operated by the user, the foam pad being of the type described with reference to FIG. 8 and being pre-compressed so as to operate within the plateau region. It will be understood that other mechanically equivalent arrangements, e.g., employing pre-loaded spring means, may be employed to secure a substantially constant exit velocity or a desired exit velocity range.

As described thus far, the nozzle designs are the blunt or bluff-ended type; however we have found that even with nozzle designs having an angular configuration as shown in FIG. 1, efficient ligamentary spraying of lower resistivity liquids with the formation of waisted or necked ligaments may, within certain limits, be secured for moderately polar liquids, i.e., less polar than water or aqueous mixtures, and having resistivities less than $1\times10^7$ ohm cm, especially in the range of $1\times10^6$ ohm cm to $1\times10^7$ ohm cm, by using a nozzle of insulating material with an outlet orifice diameter less than 350 microns and preferably of the order of 125 to 250 microns and controlling the exit velocity of the liquid from the nozzle so as to be within the range of 0.3 to 2.7 m $sec^{-1}$ (preferably 0.4 to 2.1 m $sec^{-1}$). In addition, the high voltage applied to the liquid as it discharges may need to be within certain limits but, given the above parameters, a suitable voltage can be readily determined empirically.

Even with the above described modifications, the use of nozzles of conventional angular configuration limits the liquids that can be sprayed to a practical resistivity range of about $1\times10^6$ ohm cm and upwards.

Thus, in accordance with this aspect of the invention, the embodiments of FIGS. 6, 7 and 9 may be modified by replacing the blunt-ended nozzles shown with a pointed or angular design such as that shown in FIG. 1 provided operation is restricted to the parameters specified above.

We claim:

1. A ligament mode electrostatic spraying device for spraying liquid, the device comprising:

a nozzle of pointed configuration defining a tip portion, the tip portion having an orifice;

means for supplying liquid having a resistivity less than about $1\times10^7$ Ohm-cm to the nozzle so as to be discharged through the orifice;

means for applying a high electrical potential to the liquid so that liquid supplied to the nozzle is projected from the orifice under the influence of electrostatic forces created by the potential applying means; and potential gradient attenuating means encircling the orifice for establishing a potential having the same polarity as that applied to the liquid, whereby the potential gradient in the immediate vicinity of the nozzle tip is attenuated and the liquid discharging from the orifice undergoes necking under the influence of the attenuated potential gradient to form a ligament having a cross-sectional diameter which is substantially smaller than the dimension of the orifice.

2. A device as claimed in claim 1, wherein the potential gradient attenuating means comprises an annular collar or shroud encircling the tip of the nozzle.

3. A device as claimed in claim 1, said liquid supplying means comprising:

a container for containing the liquid to be sprayed;

a user-operable member; and pressure applying means for applying pressure to liquid stored in the container responsive to said user-operable member.

4. A device as claimed in claim 3, wherein:

said container has flexible walls and application of pressure to the container deforms the container, thereby expelling liquid from the container for supply to said nozzle.

* * * * *